US005760793A

United States Patent [19]

Ellert et al.

[11] Patent Number: 5,760,793

[45] Date of Patent: Jun. 2, 1998

[54] LOW LATENCY UPDATE OF GRAPHIC OBJECTS IN AN AIR TRAFFIC CONTROL DISPLAY

[75] Inventors: James W. Ellert, Placentia; Michael L. Bronson, Fullerton, both of Calif.

[73] Assignee: Raytheon Company, Lexington, Mass.

[21] Appl. No.: 877,413

[22] Filed: Jun. 16, 1997

Related U.S. Application Data

[63] Continuation of Ser. No. 250,081, May 27, 1994, abandoned.

[51] Int. Cl.[6] ..... G09G 5/36

[52] U.S. Cl. ..... 345/509; 345/507

[58] Field of Search ..... 345/97, 98, 507, 345/515, 509, 516, 191

[56] References Cited

U.S. PATENT DOCUMENTS 5,214,414 5/1993 Levine et al. ..... 345/157
5,438,376 8/1995 Watanabe ..... 345/200
5,481,274 1/1996 Aratiani et al. ..... 345/98

FOREIGN PATENT DOCUMENTS 0 566 387 A2 10/1993 European Pat. Off. .
WO 92/01281 1/1992 WIPO .
WO 94/10639 5/1994 WIPO .

*Primary Examiner*—Amare Mengistu
*Attorney, Agent, or Firm*—W. C. Schubert; G. H. Lenzen, Jr.

[57] ABSTRACT

A video display system that includes a video display for displaying a raster image comprised of an array of pixels arranged in rows and columns, a video memory for storing pixel raster image data for the raster image, a bit-map memory, and a processor for rendering into the bit-map memory updated pixel raster image data for a rectangular region of pixels of the raster image that is less than the entire raster image, and for copying the updated pixel raster image data to the bit-map memory at locations that store raster image data for the rectangular region of pixels.

9 Claims, 1 Drawing Sheet

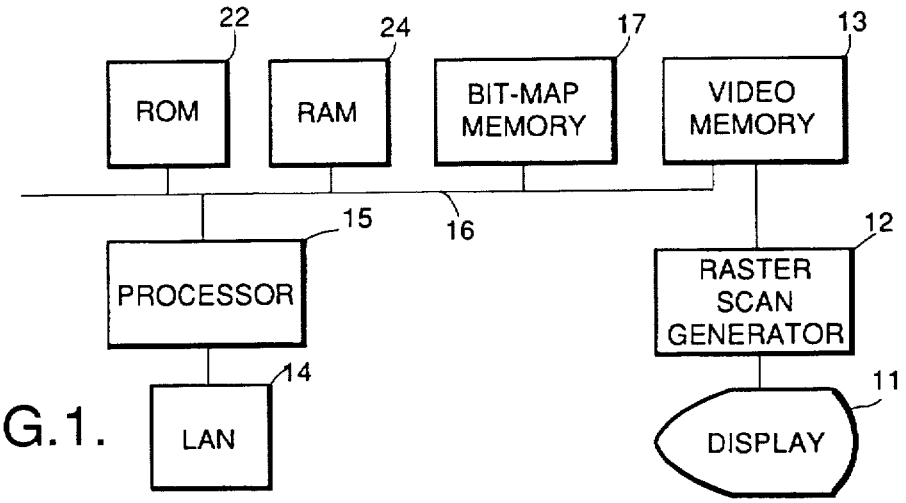
FIG.1.
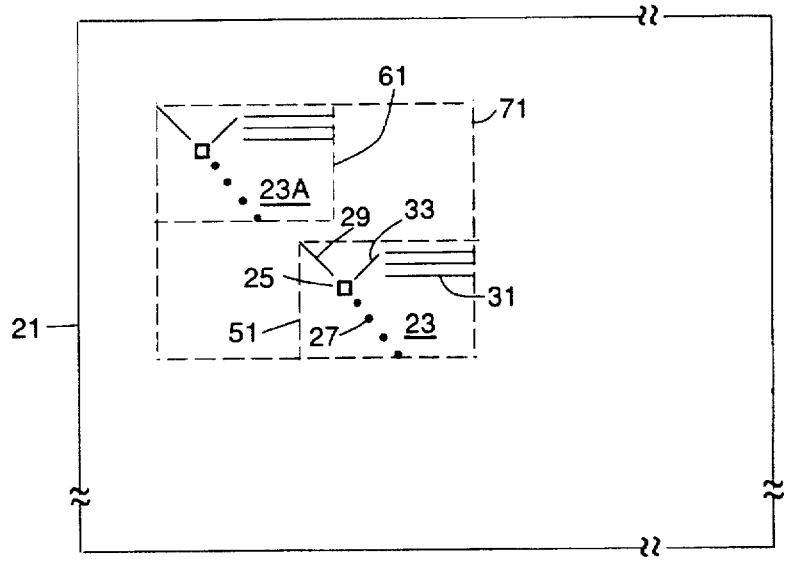
FIG.2.
FIG.3.
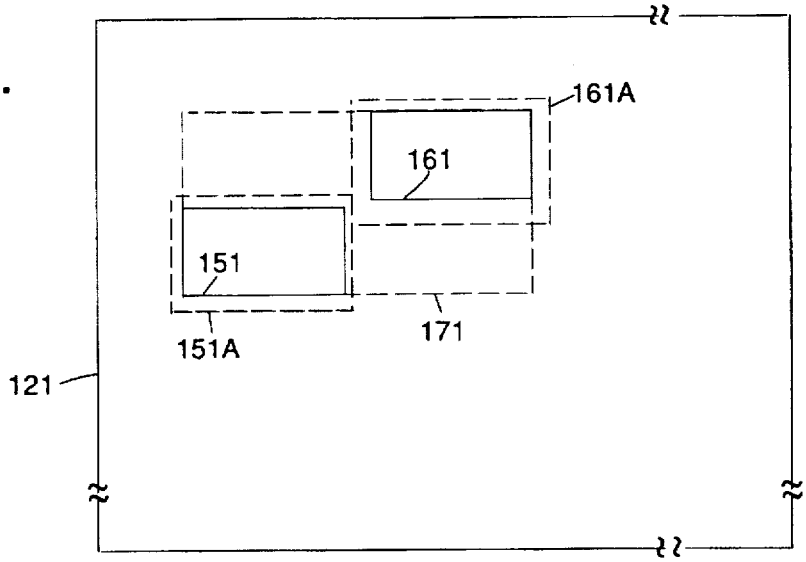

LOW LATENCY UPDATE OF GRAPHIC OBJECTS IN AN AIR TRAFFIC CONTROL DISPLAY

This is a continuation of application Ser. No. 08/250,081 filed May 27, 1994 now abandoned.

BACKGROUND OF THE INVENTION

The disclosed invention is generally directed to a raster video display system, and more particularly to a raster video display system wherein the video display is efficiently updated changing only a portion of the display that requires updating.

As is well known, a raster video display system provides a video image by illuminating selected pixels of a pixel array of a video display. The pixels of a pixel array are arranged in a raster of rows and columns, and define the locations on the video display which can be illuminated. Each pixel has a unique address that is defined for example by a row coordinate and a column coordinate, and data that represents the attributes of each pixel (i.e., color and intensity) is stored in a video memory or frame buffer.

Raster video display systems are utilized in a wide range of applications including Air Traffic Control (ATC). An important consideration with raster video display systems, like in any video display system, is the need to update the video image pursuant to changes in the information represented by the video image. For the particular example of an ATC situation display, which is basically a top plan view of aircraft traffic in a fixed geographical region, the video image needs to be updated to reflect changes in positions of aircraft represented on the display. Typically, the video image of a raster video display system is updated by rendering (i.e., generating) raster image data for the entire display, for example by executing drawing instructions contained in the display lists that define all of the graphic objects to be displayed in the video image. As is well known, a display list for a graphic object comprises a list of drawing and graphical attribute instructions for primitives or fundamental shapes that form a graphic object. Depending on the number of graphic objects displayed, rendering updated raster image data for a video display can be time consuming, whereby an updated video image might be unduly delayed relative to the real-time occurrence of the updated information. Such latency can be reduced by utilizing more powerful processors, which increases cost and complexity.

SUMMARY OF THE INVENTION

It would therefore be an advantage to provide a video display system that efficiently updates its video image with reduced latency between the receipt of updated information and the display of the updated video image.

The foregoing and other advantages are provided by the invention in a video display system that includes a video display for displaying a raster image comprised of an array of pixels arranged in rows and columns, a video memory for storing raster image data for the raster image, a bit-map memory, and a processor for rendering into the bit-map memory updated raster image data for a rectangular region of pixels of the raster image that is less than the entire image, and for copying the updated raster image data to the video memory at locations that store raster image data for the rectangular region of pixels.

BRIEF DESCRIPTION OF THE DRAWINGS

The advantages and features of the disclosed invention will readily be appreciated by persons skilled in the art from the following detailed description when read in conjunction with the drawing wherein:

FIG. 1 is a block diagram of a display system in accordance with the invention.

FIG. 2 schematically depicts update of a graphic object displayed by the display system of FIG. 1 for the particular implementation thereof for an ATC situation display.

FIG. 3 schematically depicts update of a plurality of graphic objects displayed by the display system of FIG. 1 for the particular implementation thereof for an ATC situation display.

DETAILED DESCRIPTION OF THE DISCLOSURE

In the following detailed description and in the several figures of the drawing, like elements are identified with like reference numerals.

Referring now to FIG. 1, set forth therein is a block diagram of a video display system in accordance with the invention which includes a raster scan generator 12 which converts raster image data stored in a video memory 13 to video signals that are provided to a raster video display 11 that displays a raster image that is representative of the raster image data stored in the video memory 13. In accordance with conventional display techniques, the raster video display 11 produces a visible video raster image that is comprised of an array of uniquely addressable pixels arranged in rows and columns on a screen of the video display. The image is more particularly formed by selective illumination of the pixels such that they are visible relative to background pixels which may be dark or of a predetermined color. The pixel data that defines the attributes of each pixel is stored in a corresponding memory location in the video memory 13. For convenience, the pixel data for a pixel in the raster image is sometimes called a pixel and the particular meaning of the term pixel should be understood from the context in which such term is utilized.

The raster image data contained in the video memory represents an image that is to be displayed by the video display, and is "rendered" (i.e., generated) by a processor 15, for example by executing drawing and graphical attribute instructions contained in display lists each of which contains drawing instructions for rendering a graphic object. By way of illustrative example, the processor 15 receives data to be displayed from a local area network (LAN) 14. The raster image data stored in the video memory 13 is more particularly rendered by the processor 15 into a bit-map memory 17 which is of at least the same size as the video memory 13. The rendered raster image data is then copied to the video memory 13 upon completion of the rendered raster image data. In accordance with conventional architectures, the display system includes a read-only memory (ROM) 22 and a random access memory (RAM) 24 which are utilized by the processor 15. The processor 15, the bit-map memory 17, the video memory 13, the ROM 22, and the RAM 24 are interconnected by a bus 16.

In accordance with the invention, the raster image data in the video memory 13 is updated by re-rendering only that portion of the raster image data that corresponds to a rectangular portion of the raster image that needs to be updated and which is less than the entire raster image. FIG. 2 schematically depicts the operation of the invention for the particular implementation of an ATC situation display that produces a raster image 21. The raster image 21 is shown without the individual pixels to avoid clutter, and it should be appreciated that the pixels of the raster image 21 would be arranged in rows and columns in accordance with conventional techniques. By way of illustrative example, each pixel has a row coordinate and a column coordinate which are referenced to an origin that located at the upper left corner of the raster image 21. An ATC situation display displays various graphic objects, some of which are stationary such as lines that depict airspace boundaries, while others such as "tracks" are more dynamic. A "track" object 23 is schematically depicted in FIG. 2 and comprises a graphic object that includes at least a track symbol 25 that represents an aircraft, dots 27 that represent the tracked horizontal path of the aircraft, a velocity vector 29 that represents the instantaneous horizontal trajectory of the aircraft, an alphanumerical data block 31 that contains information about the aircraft such as call sign, current altitude and assigned altitude. The track object 23 also includes a "leader line" 33 that leads from the data block 31 to the aircraft symbol 25. The display list for the track object 23 includes a definition of a bounding rectangle 51 which is the smallest rectangle that encloses all of the pixels of the raster image that are affected by the display list for the track object 23. For example, the bounding rectangle is defined by its upper left corner and its lower right corner. The row coordinate of the upper left corner of the bounding rectangle 51 corresponds to the uppermost pixel row that contains at least one pixel that is included in the displayed track object 23 and the column coordinate of the upper left corner of the bounding rectangle 51 corresponds to the leftmost pixel column that contains a pixel that is included in the displayed track object 23. Similarly, the row coordinate of the lower right corner of the bounding rectangle 51 corresponds to the lowermost pixel row that contains at least one pixel that is included in the displayed track object 23, and column coordinate of the lower right corner of the bounding rectangle 61 corresponds to the rightmost pixel column that contains at least one pixel that is included in the displayed track object 23.

Since an aircraft is moving, the track object 23 for an aircraft needs to be updated as to location in the display as well as to its contents. Effectively, the track object 23 needs to be erased and then re-displayed at a different location as an updated track object 23A with possibly different information. The updated track object 23A is shown for convenience as being non-overlapping with respect to the track object 23, and it should be appreciated that there is no limitation as to whether an updated object overlaps the object being updated. Since updating a graphic object involves erasing the graphic object in its old state and displaying such graphic object in its new state, it will sometimes be convenient to refer to a graphic object in its old state prior to update as the old or earlier graphic object, and to refer to a graphic object in its new or updated state after update as the updated or new graphic object.

In accordance with the invention, a graphic object such as the track object 23 is updated as follows. A display list that includes a definition of a bounding rectangle 61 is generated for the updated track object 23A, wherein the bounding rectangle 61 is the smallest rectangle that encloses all of the pixels of the raster image that are affected by the display list for the updated track object 23A. The smallest update rectangle 71 that encloses both bounding rectangles 51, 61 is determined, wherein such update rectangle encloses less than the entire raster image 21. The update rectangle 71 thus defines a rectangular area that includes pixels that will display the updated track object 23A and pixels that displayed the old track object 23. The update rectangle 71 is determined, for example, by defining a rectangle having (a) an upper left corner whose row coordinate corresponds to the uppermost of the row coordinates of the upper left corners of the bounding rectangles 51, 61 and whose column coordinate corresponds to the leftmost of the column coordinates of the upper left corners of the bounding rectangles 51, 61, and (b) a lower right corner whose row coordinate corresponds to the lowermost of the row coordinates of the lower right corners of the bounding rectangles 51, 61 and whose column coordinate corresponds to the rightmost of the column coordinates of the lower right corners of the bounding rectangles 51, 61. In accordance with the invention, the processor 15 renders into the bit-map memory 17 updated raster image data for the pixels enclosed by the update rectangle 71, for example by executing the instructions of the display list for the updated track object 23A as well as the instructions for all other graphic objects contained within the update rectangle 71. Such updated raster image data contains the pixel data required to display the updated track 23A at its updated position, and further contains the pixel data for all other objects or portions of objects within the update rectangle.

The updated raster image data for the pixels contained within the update rectangle is then copied into the video memory 13 at memory locations for the pixels contained within the update rectangle 71. Pursuant to such copying, the updated raster image containing the updated track object 23A is displayed in a raster scan that is immediately subsequent to a raster scan that produced a display of the raster image containing the old track object 23, whereby the old track object 23 is erased at the same time that the updated track object 23A is displayed. This provides for a flicker-free update of the track object 23, which in an ATC application reduces stress for an air traffic controller who is utilizing the display system.

Referring now to FIG. 3, schematically depicted therein is a further operation in accordance with the invention wherein a raster image 121 is updated by re-rendering only that portion of the raster image data that contains a plurality of graphic objects that are to be updated, if certain conditions are satisfied. In particular, first and second objects that require updating at any given time are concurrently updated in accordance with the invention if first and second update rectangles 151, 161 for the first and second objects to be updated are sufficiently close to each other, as described further herein. The update rectangles 151, 161 are shown in solid lines for ease of reference, and it should be appreciated that the lines that form the rectangles would actually not be included in the raster image 121. Like the update rectangle 51 of FIG. 2, the first update rectangle 151 encloses the bounding rectangle of a first graphic object in its old state and the bounding rectangle of the first graphic object in its new state, and the second update rectangle 161 encloses the bounding rectangle of a second graphic object in its old state and the bounding rectangle of the second graphic object in its new state.

The determination as to whether the first update rectangle 151 is sufficiently close to the second update rectangle 161 is made as follows. A first peripheral rectangle 151A that surrounds the first update rectangle 151 and is displaced therefrom by a predetermined number of pixels is determined, a second peripheral rectangle 161A that surrounds the second update rectangle 161 and is displaced therefrom by a predetermined number of pixels is determined. For the illustrative example wherein the origin of the row and column coordinates of the pixel array is at the top left corner, the first peripheral rectangle 151A is defined for example by reducing each of the row and column coordinates of the upper left corner of the update rectangle 151 by a predetermined constant, and by increasing each of the row and column coordinates of the lower right corner of the update rectangle by such predetermined constant. Similarly, the second periphery rectangle 161A is defined for example by reducing each of the row and column coordinates of the upper left corner of the update rectangle 161 by the predetermined constant utilized to define the first peripheral rectangle 151A, and by increasing each of the row and column coordinates of the lower right corner of the update rectangle by such predetermined constant. If the first and second peripheral rectangles 151A, 161A overlap, then a batch rectangle 171 that is the smallest rectangle that encloses the first and second update rectangles 151, 161 is defined. The batch rectangle 171 is defined for example by (a) an upper left corner whose row coordinate corresponds to the uppermost of the row coordinates of the upper left corners of the update rectangles 151, 161 and whose column coordinate corresponds to the leftmost of the column coordinates of the upper left corners of the update rectangles 151, 161, and (b) a lower right corner whose row coordinate corresponds to the lowermost of the row coordinates of the lower right corners of the update rectangles 151, 161 and whose column coordinate corresponds to the rightmost of the column coordinates of the lower right corners of the update rectangles 151, 161. In accordance with the invention, the processor 15 renders into the working bit-map memory updated raster image data for the pixels enclosed by the batch rectangle 171. Such updated pixel data contains the pixel data required to display the updated graphic objects contained in the update rectangles 151, 161, and further contains the pixel data for all other objects or portions of objects contained in the batch rectangle 171.

Effectively, the first and second update rectangles are sufficiently proximate for concurrent updating if the separation between the first and second update rectangles as measured along a pixel row axis is less than a predetermined number of pixels, where such predetermined number of pixels is two times the predetermined constant referred to above, or if the separation between the first and second update rectangles as measured along a pixel column axis is less than such predetermined number of pixels.

The updated raster image data for the pixels contained within the batch rectangle 171 is then copied into the video memory at the locations for the pixels contained within the batch rectangle 171. Pursuant to such copying, the updated raster image containing the updated objects in the update rectangles 151, 161 is displayed in a raster scan that is immediately subsequent to a raster scan that produced a display of the raster image containing the earlier graphic objects in the update rectangles 151, 161, whereby the old graphic objects in the update rectangles 151, 161 are erased at the same time that the updated first and second graphic objects are displayed. This provides for a flicker-free update of the graphic objects contained in the update rectangles 151, 161.

Thus, the foregoing has been a disclosure of a raster display system that provides for enhanced, low latency video update performance with reduced processing resource consumption and reduced hardware requirements. The display system of the invention is utilized advantageously with or without transparencies which are conventional groupings of image raster data. As is well known, a transparency is formed by organizing image raster data into bit planes wherein a bit plane is comprised of a given bit from each and every pixel in the image raster data, and designating one or more bit planes as a transparency. Graphic objects are assigned to transparencies based on their rate of update, which allows objects in one transparency to be updated without damage to objects in another transparency.

Although the foregoing has been a description and illustration of specific embodiments of the invention, various modifications and changes thereto can be made by persons skilled in the art without departing from the scope and spirit of the invention as defined by the following claims.

What is claimed is:

1. A raster video display system comprising:

video display means for displaying a raster image comprised of an array of pixels arranged in rows and columns;

a graphic object within a physical environment, said graphic object described by said raster image;

a video memory for storing raster image data for said raster image, said raster image data containing respective pixel data for each of said pixels;

a bit-map memory, said bit-map memory being of at least the same size as said video memory;

processing means for rendering input data to be displayed into raster image data, said processing means including means for updating the raster image data in the video memory by re-rendering only that portion of the raster image data that corresponds to a rectangular portion of the raster image that needs to be updated due to changes in a graphic object within the rectangular portion, thereby reducing processing loading, said rectangular portion including less than all of the pixels in the raster image, said updating means for rendering into said bit-map memory updated pixel data for pixels enclosed by a rectangle that encloses said rectangular portion and contains less than all of the pixels of said raster image, said processing means further copying said updated pixel data to said video memory at locations that store pixel data for the pixels enclosed by said rectangle.

2. The raster video display system of claim 1 wherein said updated pixel data for said pixels enclosed by said rectangle includes pixel data for pixels that display said graphic object contained in said raster image.

3. The raster video display system of claim 1 wherein said updated pixel data for said pixels enclosed by said rectangle includes pixel data for pixels that display a graphic object in an updated state and pixel data for pixels that displayed said graphic object in an earlier state.

4. A raster video display system comprising:

video display means for displaying a raster image comprised of an array of pixels arranged in rows and columns, said raster image representative of a respective graphic object capable of changing position within a physical environment;

a video memory for storing pixel data for said raster image, said pixel data containing respective pixel data for each of said pixels;

a bit-map memory, said bit-map memory being of at least the same size as said video memory;

processing means for rendering into said bit-map memory updated pixel data for pixels enclosed by a batch rectangle that encloses less than all of the pixels of said raster image, wherein said batch rectangle encloses first and second update rectangles each update rectangle enclosing a plurality of pixels that display said respective graphic object in a new position within said physical environment as well as pixels that displayed said respective graphic object in an earlier position within said physical environment, said processing means further copying said updated pixel raster image data to said video memory at locations that store raster image data for pixels enclosed by said batch rectangle.

5. The display system of claim 4 wherein said first and second update rectangles sufficiently proximate such that either the separation between the first and second update rectangles as measured along a pixel row axis is less than a predetermined number of pixels, or the separation between the first and second update rectangles as measured along a pixel column axis is less than said predetermined number of pixels.

6. A raster video display system, comprising:

video display means for displaying a raster image comprised of an array of pixels arranged in rows and columns, said raster image including a plurality of graphic objects;

a video memory for storing raster image data for said raster image, said raster image data containing respective pixel data for each of said pixels;

a raster scan generator coupled to said video memory and said video display means for converting said raster image data into video signals provided to said video display means for successive raster scans to produce successive displays of the raster image defined by the raster image data stored in said video memory;

a bit-map memory;

processing means for rendering input data to be displayed into raster image data, said processing means including means for updating the raster image data in the video memory by re-rendering only that portion of the raster image data that corresponds to a rectangular portion of the raster image that needs to be updated due to changes in a graphic object within said rectangular portion, thereby reducing processor loading, said updating means for rendering into said bit-map memory updated pixel data for pixels enclosed by a rectangle enclosing said rectangular portion, said processing means further comprising means for copying said updated pixel data to said video memory at locations that store pixel data for the pixels enclosed by said rectangle.

7. The system of claim 6 wherein said raster scan generator produces video signals for a raster scan image including said updated pixel data in a raster scan that is immediately subsequent to a raster scan that produced a display of a raster scan image containing original pixel data in said rectangle, whereby original graphic object data in said rectangle is erased at the same time that updated graphic objects in said rectangle are displayed, thereby producing a flicker-free update of graphic objects contained in said rectangle.

8. An air traffic control video display system, comprising:

video display means for displaying a raster image comprised of an array of pixels arranged in rows and columns, said raster image including a plurality of graphic objects, said graphic objects including one or more track objects representing a moving object being tracked by the system;

a video memory for storing raster image data for said raster image, said raster image data containing respective pixel data for each of said pixels;

a raster scan generator coupled to said video memory and said video display means for converting said raster image data into video signals provided to said video display means for successive raster scans to produce a display of the raster image;

a bit-map memory;

processing means for rendering input data to be displayed into raster image data, said input data including data regarding said graphic objects, said processing means including means for updating the raster image data in the video memory to reflect changes in track object positions by re-rendering only that portion of the raster image data that corresponds to a rectangular portion of the raster image that needs to be updated due to changes in track objects in the rectangular portion, said updating means for rendering into said bit-map memory updated pixel data for pixels enclosed by a rectangle enclosing said rectangular portion, said processing means further comprising means for copying said updated pixel data to said video memory at locations that store pixel data for the pixels enclosed by said rectangle.

9. The system of claim 8 wherein said raster scan generator produces video signals for a raster scan image including said updated pixel data in a raster scan that is immediately subsequent to a raster scan that produced a display of a raster scan image containing original pixel data in said rectangle, whereby original graphic object data in said rectangle is erased at the same time that updated graphic objects in said rectangle are displayed, thereby producing a flicker-free update of graphic objects contained in said rectangle.

* * * * *